US007458252B2

(12) United States Patent
Freemark et al.

(10) Patent No.: US 7,458,252 B2
(45) Date of Patent: Dec. 2, 2008

(54) FLUID ANALYSIS METHOD AND APPARATUS

(75) Inventors: Darcy Freemark, Devon (CA); Craig Borman, Camrose (CA); Ahmed Hammami, Edmonton (CA); Moin Muhammed, Edmonton (CA); Scott Jacobs, Edmonton (CA); Jonathan W. Brown, Sugar Land, TX (US); Andrew L. Kurkjian, Sugar Land, TX (US); Chengli Dong, Sugar Land, TX (US); Brindesh Dhruva, Missouri City, TX (US); Kenneth L. Havlinek, Houston, TX (US); Anthony R. H. Goodwin, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 104 days.

(21) Appl. No.: 10/908,161

(22) Filed: Apr. 29, 2005

(65) Prior Publication Data

US 2006/0243033 A1 Nov. 2, 2006

(51) Int. Cl.
*G01N 7/00* (2006.01)

(52) U.S. Cl. ..... 73/64.45

(58) Field of Classification Search ..... 73/64.45
See application file for complete search history.

(56) References Cited

U.S. PATENT DOCUMENTS

| | | | | |
|---|---|---|---|---|
| 3,954,006 | A | 5/1976 | Anderson et al. | |
| 4,782,695 | A | 11/1988 | Glotin et al. | |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,329,811 | A | 7/1994 | Schultz et al. | |
| 5,859,430 | A | 1/1999 | Mullins et al. | |
| 5,934,374 | A * | 8/1999 | Hrametz et al. | 166/264 |
| 6,178,815 | B1 | 1/2001 | Felling et al. | |
| 6,274,865 | B1 | 8/2001 | Schroer et al. | |

(Continued)

FOREIGN PATENT DOCUMENTS

| | | |
|---|---|---|
| GB | 2362960 | 5/2001 |

(Continued)

OTHER PUBLICATIONS

Walker, I.R., "Circulation Pump for High Purity Gases at High Pressure and a Novel Linear Motor Positioning System," Rev. Sc. Instrum. 67 (2), Feb. 1996, pp. 564-578.

(Continued)

*Primary Examiner*—Hezron Williams
*Assistant Examiner*—Rodney T Frank
(74) *Attorney, Agent, or Firm*—Dave R. Hofman; Darla Fonseca; Jaime Castano

(57) ABSTRACT

A fluid analysis assembly for analyzing a fluid the fluid analysis assembly includes a chamber, a fluid movement device, a pressurization assembly and at least one sensor. The chamber defines an evaluation cavity for receiving the fluid. The fluid movement device has a force medium applying force to the fluid to cause the fluid to move within the cavity. The pressurization assembly changes the pressure of the fluid in a continuous manner. The at least one sensor communicates with the fluid for sensing at least one parameter of the fluid while the pressure of the fluid is changing in the continuous manner.

25 Claims, 7 Drawing Sheets

U.S. PATENT DOCUMENTS

| | | | | |
|---|---|---|---|---|
| 6,301,959 | B1 | 10/2001 | Hrametz et al. | |
| 6,343,507 | B1 | 2/2002 | Felling et al. | |
| 6,467,544 | B1 | 10/2002 | Brown et al. | |
| 6,474,152 | B1 | 11/2002 | Mullins et al. | |
| 6,476,384 | B1 | 11/2002 | Mullins et al. | |
| 6,585,045 | B2 | 7/2003 | Lee et al. | |
| 6,609,568 | B2 | 8/2003 | Krueger et al. | |
| 6,659,177 | B2 | 12/2003 | Bolze et al. | |
| 6,688,390 | B2 | 2/2004 | Bolze et al. | |
| 6,719,049 | B2 | 4/2004 | Sherwood et al. | |
| 6,755,086 | B2 | 6/2004 | Salamitou et al. | |
| 6,768,105 | B2 | 7/2004 | Mullins et al. | |
| 6,842,700 | B2 | 1/2005 | Poe | |
| 6,850,317 | B2 | 2/2005 | Mullins et al. | |
| 6,854,341 | B2 | 2/2005 | Oddie et al. | |
| 6,898,963 | B2 | 5/2005 | Irani | |
| 6,964,301 | B2 * | 11/2005 | Hill et al. | 166/264 |
| 7,100,689 | B2 * | 9/2006 | Williams et al. | 166/264 |
| 2003/0033866 | A1 | 2/2003 | Diakonov et al. | |
| 2004/0000433 | A1 | 1/2004 | Hill et al. | |
| 2004/0045706 | A1 | 3/2004 | Pop et al. | |
| 2006/0070426 | A1 | 4/2006 | Pelletier | |

FOREIGN PATENT DOCUMENTS

| | | |
|---|---|---|
| GB | 2397382 | 7/2004 |
| WO | WO02/31476 | 4/2002 |

OTHER PUBLICATIONS

Sterner, Charles J., "Electromagnetic Pump for Circulating Gases at Low Flow Rates," Rev. Sc. Instruments, Oct. 1960, vol. 31, Issue 10, pp. 1159-1160.

Canfield, F.B. et al., "Electromagnetic Gas Pump for Low Temperature Service," Rev. Sci. Instrum. 34, 1431 (1963), pp. 1431-1433.

Erdman, K.L. et al., "Simple Gas Circulation Pump," Rev. Sci. Instrum. 35, 241 (1964), p. 241.

Lloyd, R.V. et al., "EPR Cavity for Oriented Single Crystals in Sealed Tubes," Rev. Sci. Instrum. 40, 514 (1969), pp. 514-515.

Mohamed, W.M. et al., "Simple High-Speed Circulating Pump for Gases," Rev. Sci. Instrum. 60 (7), Jul. 1989, pp. 1349-1350.

Duncan, S. et al., "A Double-Acting All-Glass Gas Circulating Pump," J. Sci. Instrum., 1967, vol. 44, p. 388.

Ellis, T. et al., "A Demountable Glass Circulating Pump," J. Sci. Instrum., 1962, vol. 39, pp. 234-235.

Kallo, D. et al., "Circulating Pump and Flowmeter for Kinetic Reaction Apparatus," J. Sci. Instrum., 1964, vol. 41, pp. 338-340.

* cited by examiner

FLUID ANALYSIS METHOD AND APPARATUS

BACKGROUND OF THE INVENTION

1. Field of the Invention

The present invention relates to techniques for performing formation evaluation of a subterranean formation by a down hole tool positioned in a well bore penetrating the subterranean formation. More particularly, but not by way of limitation, the present invention relates to techniques for making measurements of formation fluids.

2. Background of the Related Art

Well bores are drilled to locate and produce hydrocarbons. A down hole drilling tool with a bit at an end thereof is advanced into the ground to form a well bore. As the drilling tool is advanced, a drilling mud is pumped through the drilling tool and out the drill bit to cool the drilling tool and carry away cuttings. The drilling mud additionally forms a mud cake that lines the well bore.

During the drilling operation, it is desirable to perform various evaluations of the formations penetrated by the well bore. In some cases, the drilling tool may be removed and a wire line tool may be deployed into the well bore to test and/or sample the formation. In other cases, the drilling tool may be provided with devices to test and/or sample the surrounding formation and the drilling tool may be used to perform the testing or sampling. These samples or tests may be used, for example, to locate valuable hydrocarbons.

Formation evaluation often requires that fluid from the formation be drawn into the down hole tool for testing and/or sampling. Various devices, such as probes, are extended from the down hole tool to establish fluid communication with the formation surrounding the well bore and to draw fluid into the down hole tool. A typical probe is a circular element extended from the down hole tool and positioned against the sidewall of the well bore. A rubber packer at the end of the probe is used to create a seal with the wall of the well bore. Another device used to form a seal with the well bore is referred to as a dual packer. With a dual packer, two elastomeric rings expand radially about the tool to isolate a portion of the well bore there between. The rings form a seal with the well bore wall and permit fluid to be drawn into the isolated portion of the well bore and into an inlet in the down hole tool.

The mud cake lining the well bore is often useful in assisting the probe and/or dual packers in making the seal with the well bore wall. Once the seal is made, fluid from the formation is drawn into the down hole tool through an inlet by lowering the pressure in the down hole tool. Examples of probes and/or packers used in down hole tools are described in U.S. Pat. Nos. 6,301,959; 4,860,581; 4,936,139; 6,585,045; 6,609,568 and 6,719,049 and U.S. patent application Ser. No. 2004/0000433.

Formation evaluation is typically performed on fluids drawn into the down hole tool. Techniques currently exist for performing various measurements, pretests and/or sample collection of fluids that enter the down hole tool.

Fluid passing through the down hole tool may be tested to determine various down hole parameters or properties. Various properties of hydrocarbon reservoir fluids, such as viscosity, density and phase behavior of the fluid at reservoir conditions, may be used to evaluate potential reserves, determine flow in porous media and design completion, separation, treating, and metering systems, among others.

Additionally, samples of the fluid may be collected in the down hole tool and retrieved at the surface. The down hole tool stores the formation fluid in one or more sample chambers or bottles and retrieves the bottles to the surface while keeping the formation fluid pressurized. An example of this type of sampling is described in U.S. Pat. No. 6688390. Such samples are sometimes referred to as live-fluids. These fluids may then be sent to an appropriate laboratory for further analysis. Typical fluid analysis or characterization may include, for example, composition analysis, fluid properties and phase behavior. In some cases, such analysis may also be made at the well site surface using a transportable lab system.

Techniques have been developed to perform surface testing of the live-fluids. Many fluid measurements can require on the order of an hour or more time. For example, with phase behavior analysis or determination, the fluid begins as a single phase, liquid or gas. The temperature is held constant. The volume is expanded in a series of small steps. Before the next step in volume is taken, the pressure must be stable. In order to accelerate the time required to stabilize the pressure, the fluid is actively mixed. Such mixing typically involves stirring, churning, shearing, vibrating and/or otherwise transporting the fluid volume. During the volume expansion process or steps, optical technologies are used to detect the presence of a separate phase. For example, a 2 micron resolution high pressure camera may be used to take pictures, via an optical window, and a measurement of light absorbance may be made using Near Infra Red (NIR).

During sampling, reservoir fluid may exhibit a variety of phase transitions. Often these transitions are the result of cooling, pressure depletion and/or compositional changes that occur as the fluid is drawn into the tool and/or retrieved to the surface. The characterization of fluid phase behavior is key to the planning and optimization of field development and production. Changes of temperature (T) and pressure (P) of the formation fluid often lead to multi-phase separation (e.g., liquid-vapor, liquid-solid, liquid-liquid, vapor-liquid, etc.), and phase recombination. Similarly, a single-phase gas typically has an envelope at which a liquid phase separates, known as the dew point. These changes can affect the measurements taken during formation evaluation. Moreover, there is a significant delay in time between sampling and testing at the surface or offsite laboratories.

It is, therefore, desirable to provide techniques capable of performing formation evaluation of fluid that is representative of fluid in the formation. It is further desirable that such techniques provide accurate and real-time measurements. Such formation evaluation would need to operate within size and time constraints of well bore operations, and preferably are performed down hole. It is to such a fluid analysis assembly capable of effecting such formation evaluation that the present invention is directed.

SUMMARY OF THE INVENTION

In at least one aspect, the present invention relates to a fluid analysis assembly for analyzing a fluid. The fluid analysis assembly includes a chamber, a fluid movement device, a pressurization assembly and at least one sensor. The chamber defines an evaluation cavity for receiving the fluid. The fluid movement device has a force medium applying force to the fluid to cause the fluid to move within the cavity. The pressurization assembly changes the pressure of the fluid in a continuous manner. The at least one sensor communicates with the fluid for sensing at least one parameter of the fluid while the pressure of the fluid is changing in the continuous manner.

In one version, the chamber is characterized as a flow line, such as a re-circulating loop. In another version, the chamber includes a flow line, a bypass loop communicating with the flow line and defining the evaluation cavity, and at least one valve positioned between the flow line and the evaluation cavity of the bypass loop for selectively diverting fluid into the evaluation cavity of the bypass loop from the flow line.

In yet another version, the fluid movement device includes a pump. Optionally, the fluid movement device includes a mixing element positioned within the evaluation cavity and forming a vortex within the fluid. In this version, at least one of the sensors is desirably positioned within the vortex.

In yet a further version, the fluid movement device and the pressurization assembly are integrally formed and collectively comprise a first housing, a second housing, a first piston and a second piston. The first housing defines a first cavity communicating with the evaluation cavity of the chamber. The second housing defines a second cavity communicating with the evaluation cavity of the chamber. The first cavity has a cross-sectional area larger than a cross-sectional area of the second cavity. The first piston is positioned within the first cavity and is movable within the first cavity. The second piston is positioned with the second cavity and is movable within the second cavity. The movement of the first and second pistons is synchronized to simultaneously cause movement of the fluid and a change in the pressure within the chamber.

In a version designed to detect phase changes of the fluid, the at least one sensor desirably includes a pressure sensor, a temperature sensor, and a bubble-point sensor. The pressure sensor reads the pressure within the evaluation cavity of the chamber. The temperature sensor reads the temperature of the fluid within the evaluation cavity. The bubble-point sensor detects the formation of bubbles within the fluid.

In another aspect, the present invention relates to a down hole tool positionable in a well bore having a wall and penetrating a subterranean formation. The formation has a fluid therein. The down hole tool includes a housing, a fluid communication device, and a fluid analysis assembly. The fluid communication device is extendable from the housing for sealing engagement with the wall of the well bore. The fluid communication device has at least one inlet for receiving the fluid from the formation. The fluid analysis assembly is positioned within the housing for analyzing the fluid. The fluid analysis assembly includes a chamber, a fluid movement device, a pressurization assembly and at least one sensor. The chamber defines an evaluation cavity for receiving the fluid from the fluid communication device. The fluid movement device has a force medium applying force to the fluid to cause the fluid to move within the evaluation cavity. The pressurization assembly changes the pressure of the fluid. The at least one sensor communicates with the fluid for sensing at least one parameter of the fluid. The fluid analysis assembly can be any of the versions of the fluid analysis assembly described above.

In one version, the fluid communication device includes at least two inlets with one of the inlets receiving virgin fluid from the formation. In this version, the down hole tool further comprises a flow line receiving the virgin fluid from one of the inlets of the fluid communication device and conveying the virgin fluid into the evaluation cavity.

The present invention also relates to a method for measuring a parameter of an unknown fluid within a well bore penetrating a formation having the fluid therein. In the method, a fluid communication device of the down hole tool is positioned in sealing engagement with a wall of the well bore. Fluid is drawn out of the formation and into an evaluation cavity within the down hole tool. The fluid is moved within the evaluation cavity, and data is sampled while the fluid is being moved within the evaluation cavity.

In one version of the method, pressure is continuously changed within the evaluation cavity while the data is being sampled.

In another version of the method, a bubble point of the fluid is determined based on the sampled data.

In yet another version of the method, the evaluation cavity is defined further as a bypass loop from a main flow line, and wherein the method further comprises the steps of diverting fluid from the main flow line into a separate evaluation cavity, recirculating the diverted fluid within the separate evaluation cavity, and sampling data of the diverted fluid within the separate evaluation cavity while the diverted fluid is being recirculated.

In a further version, fluids trapped in separate evaluation cavities can be mixed, and then the mixed fluid can be recirculated. Data is then sampled of the mixed fluid while the mixed fluid is being recirculated.

In one aspect, the fluid communication device is a dual-packer, and the unknown fluid is a virgin fluid.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DEFINITIONS

Figure 2:
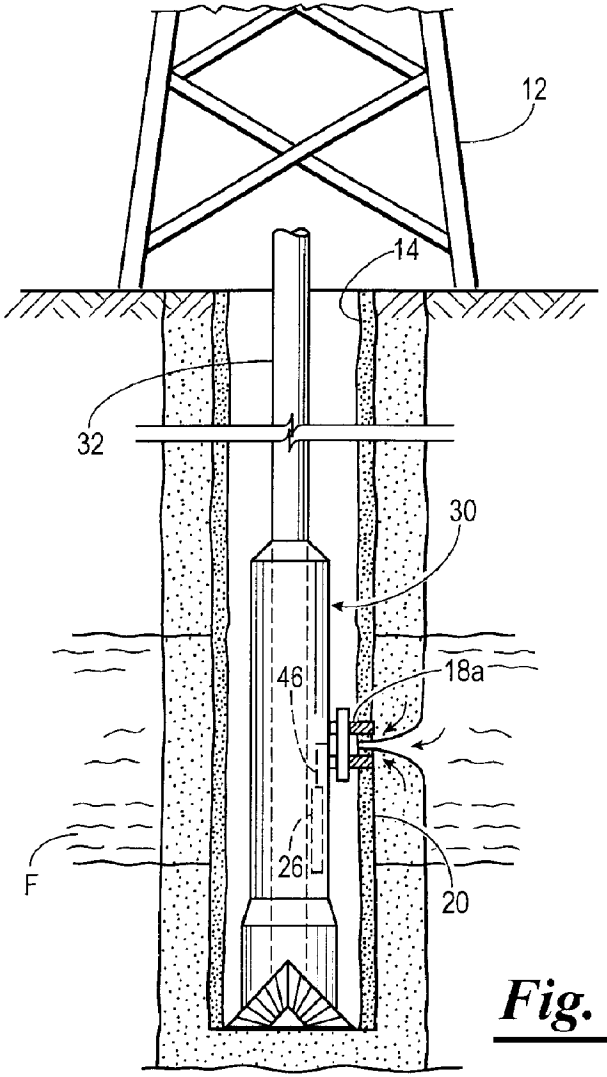
FIG. 2 is a schematic, partial cross-sectional view of a down hole drilling tool having an internal fluid analysis assembly with the down hole drilling tool suspended from a rig.

Certain terms are defined throughout this description as they are first used, while certain other terms used in this description are defined below:

"Annular" means of, relating to, or forming a ring, i.e., a line, band, or arrangement in the shape of a closed curve such as a circle or an ellipse.

"Contaminated fluid" means fluid that is generally unacceptable for hydrocarbon fluid sampling and/or evaluation because the fluid contains contaminates, such as filtrate from the mud utilized in drilling the borehole.

"Down hole tool" means tools deployed into the well bore by means such as a drill string, wire line, and coiled tubing for performing down hole operations related to the evaluation, production, and/or management of one or more subsurface formations of interest.

"Operatively connected" means directly or indirectly connected for transmitting or conducting information, force, energy, or matter (including fluids).

"Virgin fluid" means subsurface fluid that is sufficiently pure, pristine, connate, uncontaminated or otherwise considered in the fluid sampling and analysis field to be acceptably representative of a given formation for valid hydrocarbon sampling and/or evaluation.

"Fluid" means either "virgin fluid" or "contaminated fluid."

"Continuous" means marked by uninterrupted extension of time, space or sequence.

DETAILED DESCRIPTION

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 1:
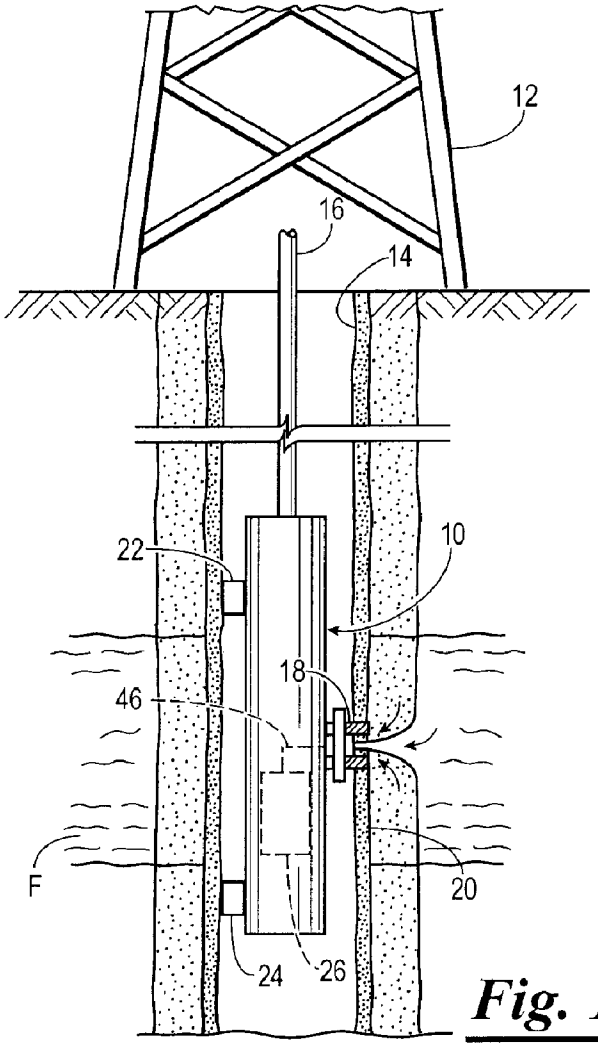
FIG. 1 is a schematic, partial cross-sectional view of a down hole wire line tool having an internal fluid analysis assembly with the wire line tool suspended from a rig.

FIG. 1 depicts a down hole tool 10 constructed in accordance with the present invention suspended from a rig 12 into a well bore 14. The down hole tool 10 can be any type of tool capable of performing formation evaluation, such as drilling, coiled tubing or other down hole tool. The down hole tool 10 of FIG. 1 is a conventional wire line tool deployed from the rig 12 into the well bore 14 via a wire line cable 16 and positioned adjacent to a formation F. An example of a wire line tool that may be used is described in U.S. Pat. Nos. 4,860,581 and 4,936,139.

The down hole tool 10 is provided with a probe 18 adapted to seal with a wall 20 of the well bore 14 (hereinafter referred to as a "wall 20" or "well bore wall 20") and draw fluid from the formation F into the down hole tool 10 as depicted by the arrows. Backup pistons 22 and 24 assist in pushing the probe 18 of the down hole tool 10 against the well bore wall 20. The down hole tool 10 is also provided with a fluid analysis assembly 26 constructed in accordance with the present invention for analyzing the formation fluid. In particular, the fluid analysis assembly 26 is capable of performing formation evaluation and/or analysis of down hole fluids, such as the formation fluids generated from formation F. The fluid analysis assembly 26 receives the formation fluid from the probe 18 via an evaluation flow line 46.

FIG. 2 depicts another example of a down hole tool 30 constructed in accordance with the present invention. The down hole tool 30 of FIG. 2 is a drilling tool, which can be conveyed among one or more (or itself may be) a measurement-while-drilling (MWD) drilling tool, a logging-while-drilling (LWD) drilling tool, or other drilling tool that are known to those skilled in the art. The down hole tool 30 is attached to a drill string 32 driven by the rig 12 to form the well bore 14. The down hole tool 30 includes a probe **18*a* adapted to seal with the wall 20 of the well bore 14 to draw fluid from the formation F into the down hole tool 30 as depicted by the arrows. The down hole tool 30 is also provided with the fluid analysis assembly 26 for analyzing the formation fluid drawn into the down hole tool 30. The fluid analysis assembly 26 receives the formation fluid from the probe 18*a* via flowline 46**.

While FIGS. 1 and 2 depict the fluid analysis assembly 26 in a downhole tool, it will be appreciated that such an assembly may be provided at the wellsite, or an offsite facility for performing fluid tests. By positioning the fluid analysis assembly 26 in the downhole tool, real time data may be collected concerning downhole fluids. However, it may also be desirable and/or necessary to test fluids at the surface and offsite locations. In such cases, the fluid analysis assembly may be positioned in a housing transportable to a desired location. Alternatively, fluid samples may be taken to a surface or offsite location and tested in a fluid analysis assembly at such a location. Data and test results from various locations may be analyzed and compared.

Figure 3:
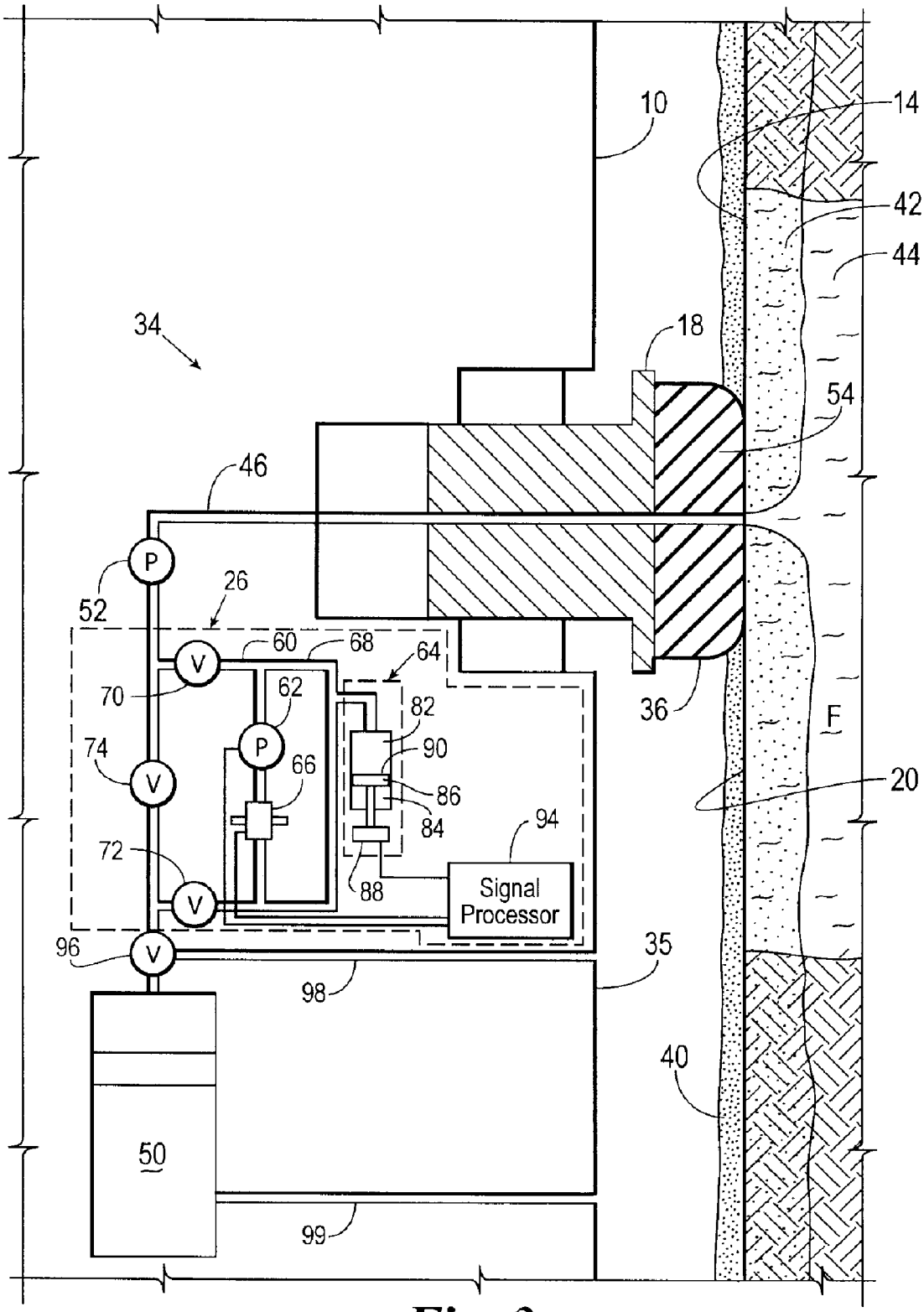
FIG. 3 is a schematic representation of a portion of the down hole tool of FIG. 1 having a probe registered against a sidewall of the well bore and an evaluation flow line of the fluid analysis assembly communicating with an internal flow line transporting formation fluid from the probe.

FIG. 3 is a schematic view of a portion of the down hole tool 10 of FIG. 1 depicting a fluid flow system 34. The probe 18 is preferably extended from a housing 35 of the down hole tool 10 for engagement with the well bore wall 20. The probe 18 is provided with a packer 36 for sealing with the well bore wall 20. The packer 36 contacts the well bore wall 20 and forms a seal with a mud cake 40 lining the well bore 14. The mud cake 40 seeps into the well bore wall 20 and creates an invaded zone 42 about the well bore 14. The invaded zone 42 contains mud and other well bore fluids that contaminate the surrounding formations, including the formation F and a portion of the virgin fluid 44 contained therein.

The fluid flow system 34 includes the evaluation flow line 46 extending from an inlet in the probe 18. While a probe is depicted for drawing fluid into the down hole tool, other fluid communication devices may be used. Examples of fluid communication devices, such as probes and dual packers, used for drawing fluid into a flow line are depicted in U.S. Pat. Nos. 4,860,581 and 4,936,139.

The evaluation flow line 46 extends into the down hole tool 10 and is used to pass fluid, such as virgin fluid 44 into the down hole tool 10 for pre-test, analysis and/or sampling. The evaluation flow line 46 extends to a sample chamber 50 for collecting samples of the virgin fluid 44. The fluid flow system 34 may also include a pump 52 used to draw fluid through the flow line 46.

While FIG. 3 shows a sample configuration of a down hole tool used to draw fluid from a formation, it will be appreciated by one of skill in the art that a variety of configurations of flow lines, pumps, sample chambers, valves and other devices may be used and is not intended to limit the scope of the invention.

As discussed above, the down hole tool 10 is provided with the fluid analysis assembly 26 for analyzing the formation fluid. In particular, the fluid analysis assembly 26 is capable of effecting down hole measurements, such as phase measurements, viscosity measurements and/or density measurements of the formation fluid. In general, the fluid analysis assembly 26 is provided with a chamber 60, a fluid movement device 62, a pressurization assembly 64, and one or more sensors 66 (multiple sensors are shown in FIGS. 4, 5A, 5B, 6 and 7 and numbered by the reference numerals 66*a-g* for purposes of clarity).

The chamber 60 defines an evaluation cavity 68 for receiving the formation fluid. It should be understood that the chamber 60 can have any configuration capable of receiving the formation fluid and permitting movement of the fluid as discussed herein so that the measurements can be effected. For example, as shown in FIG. 3, the chamber 60 can be implemented as a bypass flow line communicating with the evaluation flow line 46 such that the formation fluids can be positioned or diverted into the bypass flow line. The fluid analysis assembly 26 can also be provided with a first valve 70, a second valve 72, and a third valve 74 for selectively diverting the formation fluid into and out of the chamber 60, as well as isolating the chamber 60 from the evaluation flow line 46.

As shown, to divert the formation fluid into the chamber 60, the first valve 70, and the second valve 72 are opened, while the third valve 74 is closed. This diverts the formation fluid into the chamber 60 while the pump 52 is moving the formation fluid. Then, the first valve 70 and the second valve 72 are closed to isolate or trap the formation fluid within the chamber 60. If desired, the third valve 74 can be opened to permit normal or a different operation of the down hole tool 10. For example, valve 74 may be opened, and valves 70 and 72 closed while the fluid in chamber 60 is being evaluated. Additional valves and flow lines or chambers may be added as desired to facilitate the flow of fluid.

The fluid movement device 62 serves to move and/or mix the fluid within the evaluation cavity 68 to enhance the homogeneity, cavitation, and circulation of the fluid. Fluid is preferably moved through evaluation cavity 68 to enhance the accuracy of the measurements obtained by the sensor(s) 66. In general, the fluid movement device 62 has a force medium applying force to the formation fluid to cause the formation fluid to be recirculated within the evaluation cavity 68.

The fluid movement device 62 can be any type of device capable of applying force to the formation fluid to cause the formation fluid to be recirculated and optionally mixed within the evaluation cavity 68. The fluid movement device 62 recirculates the formation fluid within the chamber 60 past the sensor(s) 66. The fluid movement device 62 can be any type of pump or device capable of recirculating the formation fluid within the chamber 60. For example, the fluid movement device 62 can be a positive displacement pump, such as a gear pump, a rotary lobe pump, a screw pump, a vane pump, a peristaltic pump, or a piston and progressive cavity pump.

When the fluid movement device 62 mixes the fluid, one of the sensors 66 (typically characterized as an optical absorption sensor) can be positioned immediately adjacent to a discharge side of the fluid movement device 62 to be within a vortex formed by the fluid movement device 62. The sensor 66 may be any type of sensor capable of measuring fluid parameters, such as a sensor or device effecting an optical absorbance measurement.

Preferably, the pressurization assembly 64 changes the pressure of the formation fluid within the chamber 60 in a continuous manner. The pressurization assembly 64 can be any type of assembly or device capable of communicating with the chamber 60 and continuously changing (and/or stepwise changing) the volume or pressure of the formation fluid within the chamber 60. In the example depicted in FIG. 3, the pressurization assembly 64 is provided with a decompression chamber 82, a housing 84, a piston 86, and a piston motion control device 88. The piston 86 is provided with an outer face 90, which cooperates with the housing 84 to define the decompression chamber 82. The piston motion control device 88 controls the location of the piston 86 within the housing 84 to effectively change the volume of the decompression chamber 82.

As the volume of the decompression chamber 82 changes, the volume or pressure within the chamber 60 also changes. Thus, as the decompression chamber 82 becomes larger, the pressure within the chamber 60 is reduced. Likewise, when the decompression chamber 82 becomes smaller, the pressure within the chamber 60 is increased. The piston motion control device 88 can be any type of electronic and/or mechanical device capable of effecting changes in the position of the piston 86. For example, the piston motion control device 88 can be a pump exerting on a fluid on the piston 86, or a motor operably connected to the piston 86 via a mechanical linkage, such as a post, flange, or threaded screw.

Figure 6:
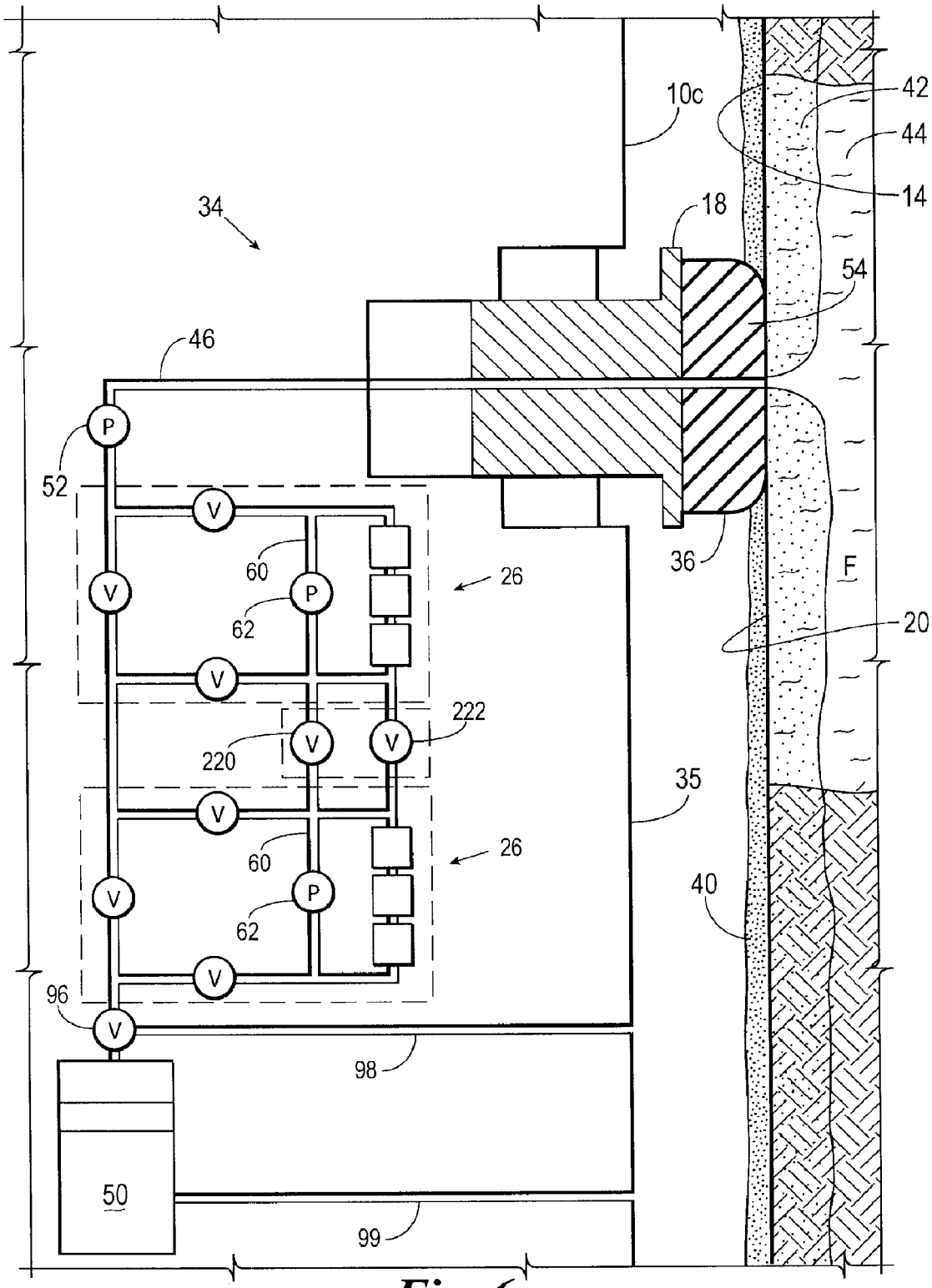
FIG. 6 is a schematic representation of a portion of another version of the down hole tool of FIG. 1 having a probe registered against a sidewall of the well bore and an evaluation flow line of the fluid analysis assembly communicating with an internal flow line transporting formation fluid from the probe.
Figure 7:
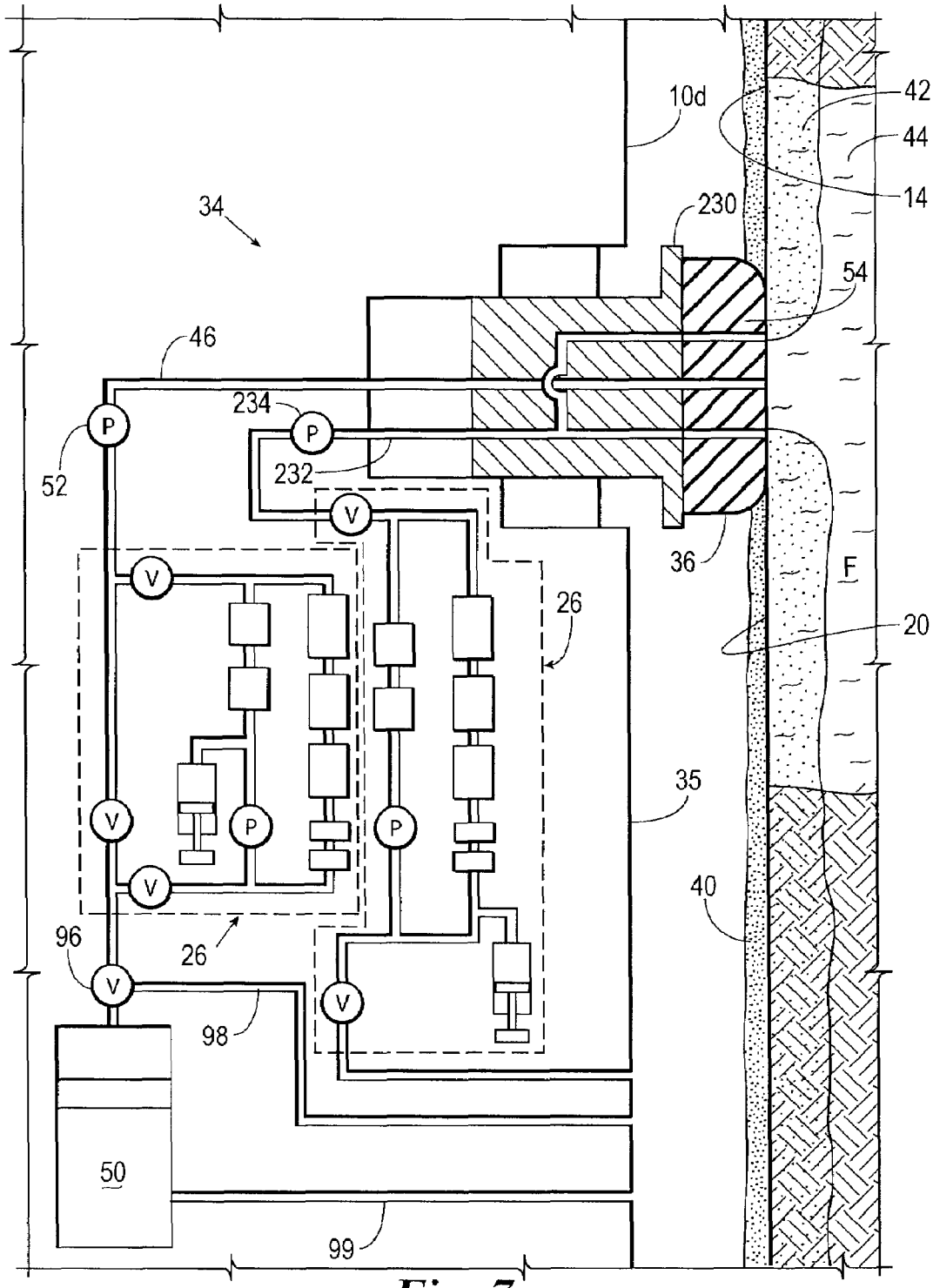
FIG. 7 is a schematic representation of a portion of another version of the down hole tool of FIG. 1 having a dual-probe registered against a sidewall of the well bore and an evaluation flow line of the fluid analysis assembly communicating with an internal flow line transporting formation fluid from the probe.

The sensor 66 can be any type of device capable of sensing information which is helpful in determining a fluid characteristic, such as the phase behavior of the formation fluid. Although only one sensor 66 is shown in FIG. 3, the fluid analysis assembly 26 can be provided with more than one sensor 66 as shown in FIGS. 6 and 7, for example. The sensors 66 can be, for example, a pressure sensor, a temperature sensor, a density sensor, a viscosity sensor, a camera, a visual cell, a NIR or the like. Preferably, at least one of the sensors 66 is used for an optical absorbance measurement. In this instance, the sensor 66 can be positioned adjacent to a window (not shown) so that the sensor 66 can view or make determinations with respect to the change in phase of the formation fluid. For example, the sensor 66 can be a video camera which would either permit viewing of the formation fluid by an individual, or take pictures of the formation fluid as it passes by the window so that such pictures could be analyzed for the presence of bubbles or other indications of a change in state of the phase of the formation.

The fluid analysis assembly 26 is also provided with a signal processor 94 communicating with the fluid movement device 62, the sensor(s) 66, and the piston motion control device 88. The signal processor 94 preferably controls the piston motion control device 88, and the fluid movement device 62 for effecting movement of the formation fluid within the chamber 60. The processor may also continuously change the pressure of the formation fluid in a predetermined manner. Although the signal processor 94 is described herein as only changing the pressure within the chamber 60 by the continuous manner, it should be understood that the signal processor 94 is adapted to modify the pressure within the chamber 60 in any predetermined manner. For example, the signal processor 94 can control the piston motion control device 88 in the continuous manner, a stepped manner, or combinations thereof. The signal processor 94 also serves to collect and/or manipulate data produced by the sensor(s) 66.

The signal processor 94 can communicate with the fluid movement device 62, the sensor(s) 66, and/or the piston motion control device 88 via any suitable communication link, such as a cable or wire communication link, an airway communication link, infrared communication link, microwave communication link, or the like. Although the signal processor 94 is illustrated as being within the housing 35 of the down hole tool 10, it should be understood by that the signal processor 94 can be provided remotely with respect to the down hole tool 10. For example, the signal processor 94 can be provided at a monitoring station located at the well site, or located remotely from the well site. The signal processor 94 includes one or more electronic or optical device(s)

capable of executing the logic to effect the control of the fluid movement device 62, and the piston motion control device 88, as well as to collect the information from the sensor(s) 66 described herein. The signal processor 94 can also communicate with and control the first valve 70, the second valve 72, and the third valve 74 to selectively divert fluid into and out of the evaluation cavity 68 as discussed above. For purposes of clarity, lines showing the communication between the signal processor 94 and the first valve 70, second valve 72 and the third valve 74 have been omitted from FIG. 3.

In use, the signal processor 94 may be used to selectively actuate valves 70, 72, and/or 74 to divert the formation fluid into the chamber 60, as discussed above. The signal processor 94 may close the valves 70 and 72 to isolate or trap the formation fluid within the chamber 60. The signal processor 94 may then actuate the fluid movement device 62 to move the formation fluid within the chamber 60 in a re-circulating manner. As shown in FIG. 3, this recirculation forms a loop that passes pressurization assembly 64, sensor 66 and fluid movement device 62. This loop is formed from a series of flowlines that are joined in fluid communication to form a flow loop. In small spaces, such as in the downhole tool, fluid typically travels through narrow flowlines. Mixing in such narrow flowlines is often difficult. The fluid is, therefore, circulated in a loop to enhance mixing of the fluid as it passes through narrow flowlines. Such loop mixing may also be desirable in other applications that do not involve narrow flowlines.

The signal processor 94 actuates the piston motion control device 88 to begin changing the pressure within the chamber 60 in a predetermined manner. In one example, the signal processor 94 actuates the piston motion control device 88 to continuously depressurize the formation fluid within the chamber 60 at a rate suitable to effect phase measurements in a short time, sometimes less than 15 minutes. While the chamber 60 is being continuously depressurized, the signal processor 94 collects data from the sensor(s) 66 to preferably effect an optical absorbance measurement (i.e. scattering) while also monitoring the pressure within the chamber 60 to provide an accurate measurement of the phase behavior of the formation fluid.

The down hole tool 10 is also provided with a fourth valve 96 for selectively diverting the formation fluid into the sample chamber 50, or to the well bore 14 via a return line 98. The down hole tool 10 may also be provided with an exit port 99 extending from a back side of sample chamber 50.

It should be understood that the fluid analysis assembly 26 can be utilized in various manners within the down hole tools 10 and 30. The description above regarding the incorporation of the fluid analysis assembly 26 within the down hole tool 10 is equally applicable to the down hole tool 30. Further, various modifications to the down hole tools 10 and 30 with respect to the fluid analysis assembly 26 is contemplated by way of the present invention. A variety of these modifications will be described below with respect to the down hole tool 10. However, it should be understood that these modifications are equally applicable to the down hole tool 30.

It should be understood that phase behavior measurements are not the only measurements that can be made and while it is plausible that phase border determinations are more sensitive to agitation it is also desirable for precise measurements of, for example, density in a multi-component mixture and also for viscosity. Indeed, measurements can be done with either continuous or step-wise depressurization. If step wise then an additional mode of operation becomes possible by performing the depressurization to the phase border twice either with the same sample or preferably with a fresh aliquot of fluid from the flow-line. If this is adopted with discrete pressure steps then the first depressurization with constant depressurization leads to a rough estimate of the phase border pressure. The rough estimate can be used in a second depressurization cycle with logarithmically decreasing step sizes used with decreasing pressure: e.g., the magnitude of the pressure decrement decreases logarithmically (or in some other mathematical manner so that the pressure decrements decrease) with decreasing pressure as the pressure tends to the estimate obtained from the first measurement. At pressures below that estimate, the pressure step size increases with decreasing pressure. This procedure can give a more precise answer.

The temperature and to a far lesser extent the pressure in the down hole tool 10 or 30 may not be equal to those of the reservoir F. To obtain estimates at the required state from the values measured at the state of the down hole tool 10 or 30 desirably includes both an estimate of the reservoir temperature and pressure and the variation of the properties with temperature and pressure and these values combined with a model that can extrapolate from one set of temperatures and pressures to another. Thus, measurements are desirably performed at that zone and while changing to another zone or retracting the down hole tool 10 or 30 so that the required derivatives can be measured and then combined with an equation of state.

FIGS. 4-7 will now be discussed. To simplify FIGS. 4-7, the signal processor 94 and associated communication links are not shown.

Figure 4:
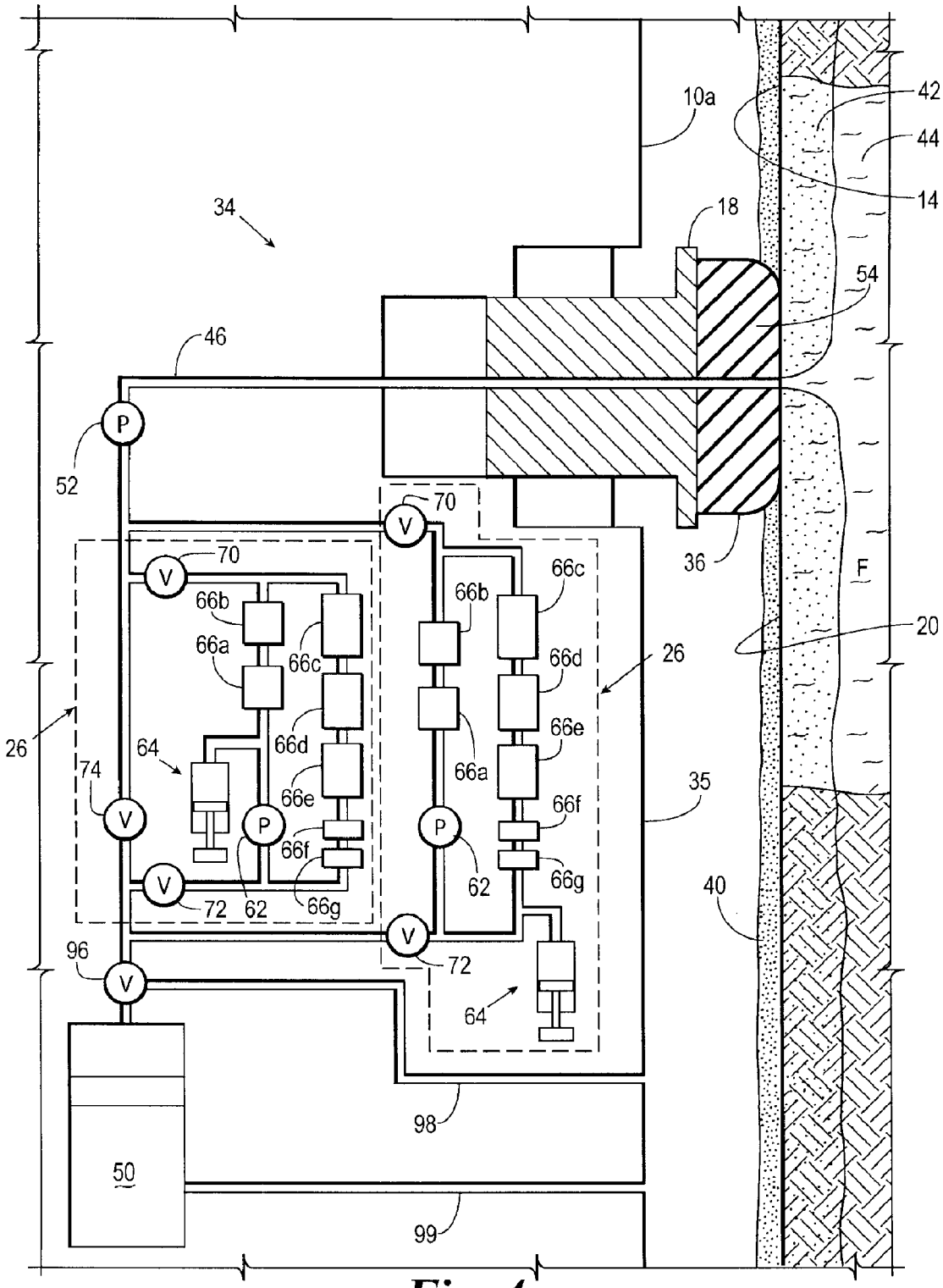
FIG. 4 is a schematic representation of a portion of yet another version of the down hole tool of FIG. 1 having a probe registered against a sidewall of the well bore and an evaluation flow line of the fluid analysis assembly communicating with an internal flow line transporting formation fluid from the probe.

Shown in FIG. 4 is a down hole tool 10*a* which is similar in construction and function to the down hole tool 10 described above with reference to FIG. 3, with the exception that the down hole tool 10*a* is provided with two fluid analysis assemblies 26. The advantage of having multiple fluid analysis assemblies 26 permits the down hole tool 10*a* to retrieve more than one sample of the formation fluid and to test the samples either simultaneously or intermittently. This permits comparisons of the results of the samples to provide a better indication of the accuracy of the down hole measurements. Although only two of the fluid analysis assemblies 26 are shown in FIG. 4, it should be understood that the down hole tool 10*a* could be provided with any number of the fluid analysis assemblies 26 at various locations in the downhole tool. In the example shown in FIG. 4, each of the fluid analysis assemblies 26 selectively communicate with the evaluation flow line 46. It should also be understood that the fluid analysis assemblies 26 can be operated independently and/or used on independent flowlines.

Figure 5A:
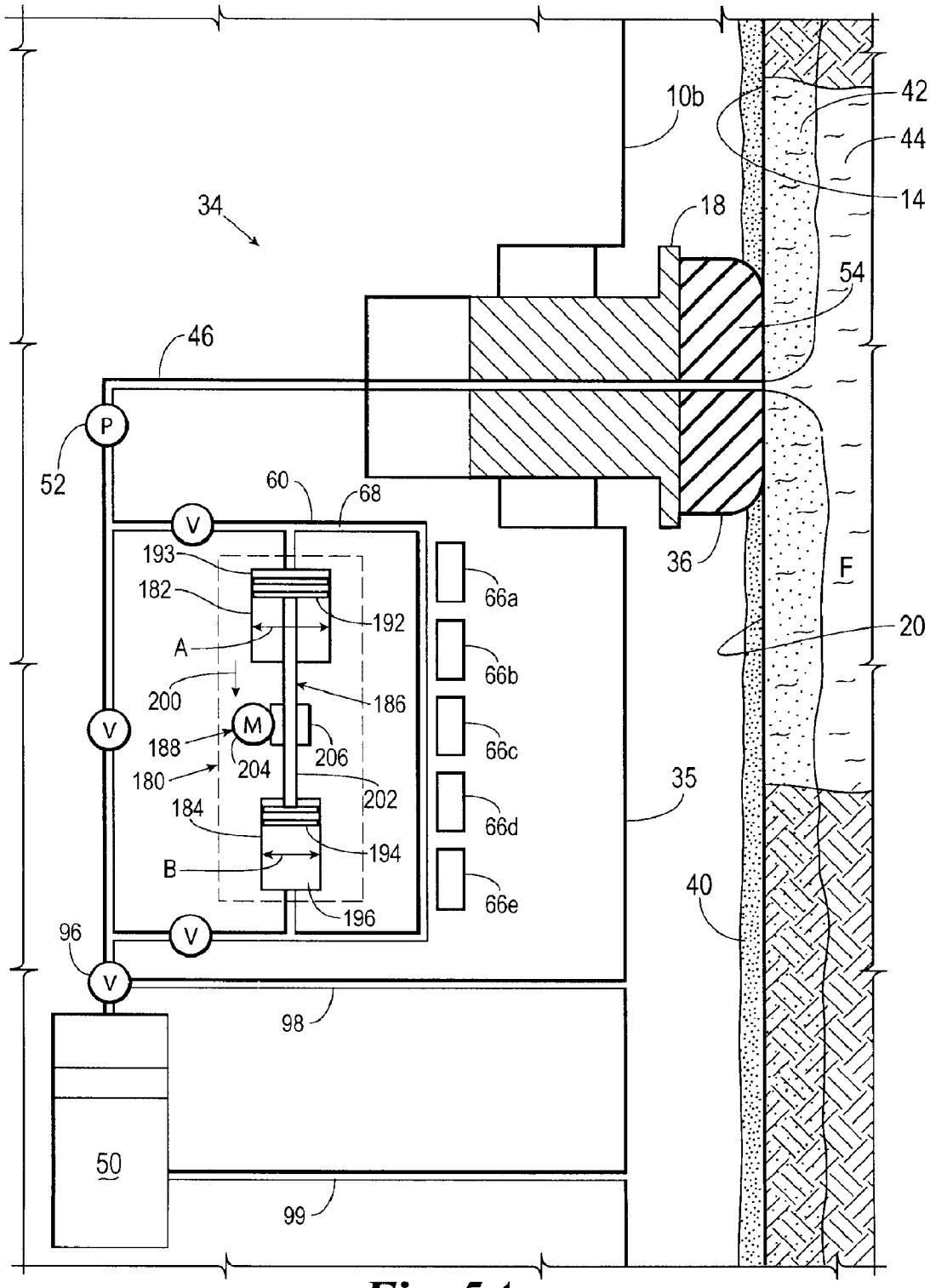
FIG. 5A is a schematic representation of a portion of another version of the down hole tool of FIG. 1 having a probe registered against a sidewall of the well bore and an evaluation flow line of the fluid analysis assembly communicating with an internal flow line transporting formation fluid from the probe.
Figure 5B:
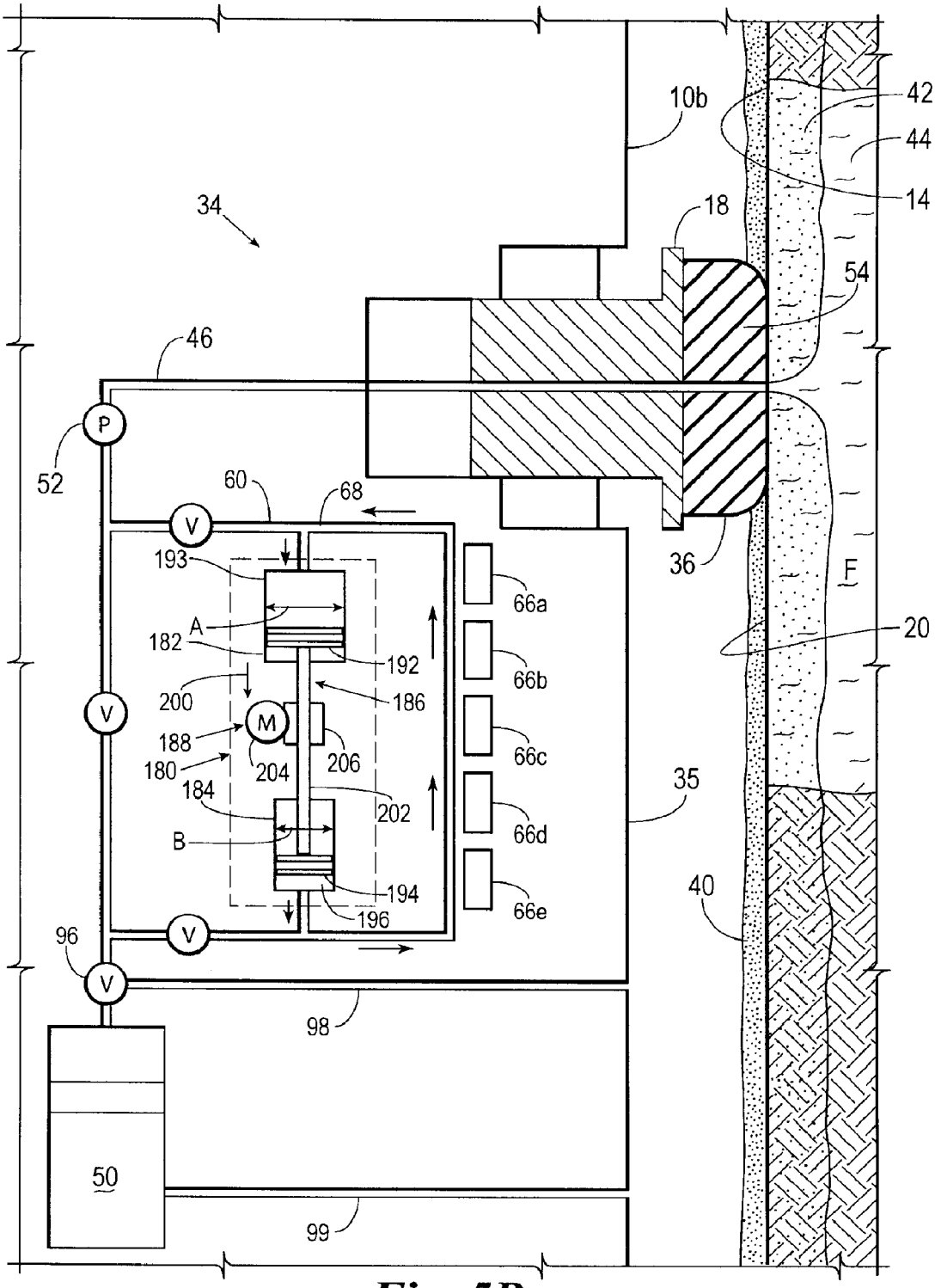
FIG. 5B is a schematic representation of the down hole tool of FIG. 5A showing the reciprocation of formation fluid within the evaluation flow line.

Shown in FIGS. 5A and 5B is a down hole tool 10*b* which is similar in construction and function to the down hole tool 10 described above with reference to FIG. 3, with the exception that the down hole tool 10*b* includes a pump assembly 180 which combines the functionality of the fluid movement device 62 and the pressurization assembly 64 of FIG. 3. FIG. 5A shows the downhole tool 10*b* with the pump assembly in the upstroke position, and FIG. 5B shows the downhole tool 10*b* with the pump assembly in the downstroke position. The pump assembly 180 is provided with a first vessel 182, a second vessel 184, a piston assembly 186, and a source of motive force 188.

The piston assembly 186 includes a first body 192 slidably positionable within the first vessel 182 to define a first chamber 193 communicating with the evaluation cavity 68. The piston assembly 186 also includes a second body 194 slidably positionable within the second vessel 184 to define a second chamber 196 communicating with the evaluation cavity 68. FIGS. 5*a* and 5*b* illustrate the movement of the first and second bodies 192 and 194.

The source of motive force 188 moves the first and second bodies 192 and 194 of the piston assembly 186 such that the formation fluid trapped within the chamber 60 is diverted past the sensors 66*a-e* and between the first and second chambers 193 and 196 as the relative positions of the first and second bodies 192 and 194 are changed. To cause a change in pressure as the first and second bodies 192 and 194 are moved, the first chamber 193 is provided with a diameter A, and the second chamber 196 is provided with a diameter B. The diameter B is preferably smaller than the diameter A. Because the first and second chambers 193 and 196 have different diameters, the combined volume of the first chamber 193, the second chamber 196, and the evaluation cavity 68 changes as the first and second bodies 192 and 194 move.

The source of motive force 188 simultaneously moves the first and second bodies 192 and 194 in a first direction 200 as shown in FIG. 5B to cause the formation fluid F to move from the second chamber 196 to the first chamber 193 past the sensors 66*a-e* while depressurizing the evaluation cavity 68. For example, if during a motion of distance (ds), the first body 192 in the first chamber 193 sucks in about 5 cc of fluid and the second body 194 in the second chamber 196 pushes out about 4.8 cc of fluid, there will be a net increase of about 0.2 cc while about 4.8 cc of formation fluid F moves past the sensors 66*a-e*.

The source of motive force 188 can be any device or devices capable of moving the first body 192 and the second body 194. For example, the piston assembly 186 can include a drive screw 202 connected to the first body 192 and the second body 194. The source of motive force 188 can drive the drive screw 202 with a motor 204 operably connected to a drive nut 206 positioned on the drive screw 202. Alternatively, a hydraulic pump can reset or control the position of the piston assembly 186.

Shown in FIG. 6 is a down hole tool 10*c* which is similar in construction and function to the down hole tool 10*a* described above with reference to FIG. 4, with the exception that the down hole tool 10*c* is further provided with one or more isolation valves 220 and 222. The down hole tool 10*c* is provided with two or more fluid analysis assemblies 26. As discussed above with reference to FIG. 4, the advantage of having multiple fluid analysis assemblies 26 permits the down hole tool 10*a* or 10*c* to retrieve more than one sample of the formation fluid and to test the samples either simultaneously or intermittently. This permits comparisons of the results of the samples to provide a better indication of the accuracy of the down hole measurements.

With the addition of the isolation valves 220 and 222 connecting the chamber 60 of one of the fluid analysis assemblies 26 to the chamber 60 of another one of the fluid analysis assemblies 26, the down hole tool 10*c* permits the isolation valves 220 and 222 to be opened so as to mix the samples separately trapped by the two fluid analysis assemblies 26. The isolation valves 220 and 222 can then be closed and the mixed formation fluids separately tested by the fluid analysis assemblies 26.

Shown in FIG. 7 is a down hole tool 10*d* which is similar in construction and function to the down hole tool 10*a* described above with reference to FIG. 4, with the exception that the down hole tool 10*d* is further provided with a probe 230 having a cleanup flow line 232 in addition to the evaluation flow line 46, and one of the fluid analysis assemblies 26 is connected to the cleanup flow line 232. The down hole tool 10*d* is also provided with a pump 234 connected to the cleanup flow line 232 for drawing contaminated fluid out of the formation and for diverting the contaminated fluid to the fluid analysis assembly 26.

The fluid analysis assemblies 26 may be used to analyze the fluid in the evaluation and cleanup flow lines 46 and 232. The information generated from the fluid analysis assemblies 26 may be used to determine such information as contamination levels. As shown, the evaluation flow line 46 is connected to the sample chamber 50 so that fluids may be sampled. Such sampling typically occurs when contamination levels fall below an accepted level. The cleanup flow line 232 is depicted as connected to the well bore 14 to dump fluid out of the tool 10*d*. Optionally, various valving can be provided for selectively diverting fluid from one of more flow lines into sample chambers or the well bore as desired.

While the down hole tools depicted herein are shown as having probes for drawing fluid into the down hole tool. It will be appreciated by one of skill in the art that other devices for drawing fluid into the down hole tool may be used. For example, dual packers may be radially expanded about the intake of one or more flow lines to isolate a portion of the well bore 14 there between, and draw fluid into the down hole tool.

Further, while the fluid analysis assembly 26 has been shown and described herein used in combination with the down hole tools 10, 10*a*, 10*b*, 10*c*, 10*d* and 30, it should be understood that the fluid analysis assembly 26 can be utilized in other environments, such as a portable lab environment, or a stationary lab environment.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A fluid analysis assembly for analyzing a fluid, the fluid analysis assembly comprising:

a chamber defining an evaluation cavity for receiving the fluid;

a fluid movement device having a force medium applying force to the fluid to cause the fluid to move within the cavity;

a pressurization assembly changing the pressure of the fluid in a continuous manner, wherein the assembly is adapted to change the pressure independently of the fluid movement device; and at least one sensor communicating with the fluid for sensing at least one parameter of the fluid while the pressure of the fluid is changing in the continuous manner, wherein the chamber is characterized as a flow line.

2. The fluid analysis assembly of claim 1, wherein the evaluation cavity of the flow line is configured as a recirculating loop.

3. The fluid analysis assembly of claim 1, wherein the chamber comprises:

a flow line;

a bypass loop communicating with the flow line and defining the evaluation cavity; and at least one valve positioned between the flow line and the evaluation cavity of the bypass loop for selectively diverting fluid into the evaluation cavity of the bypass loop from the flow line.

4. The fluid analysis assembly of claim 1, wherein the fluid movement device includes a mixing element positioned within the evaluation cavity and forming a vortex within the fluid, and wherein the sensor is positioned within the vortex.

5. The fluid analysis assembly of claim 1, wherein the fluid movement device and the pressurization assembly are integrally formed and collectively comprise:

a first housing defining a first cavity communicating with the evaluation cavity of the chamber;

a second housing defining a second cavity communicating with the evaluation cavity of the chamber, the first cavity having a cross-sectional area larger than a cross-sectional area of the second cavity;

a first piston positioned within the first cavity and movable within the first cavity; and a second piston positioned with the second cavity and movable within the second cavity, wherein the movement of the first and second pistons are synchronized to simultaneously cause movement of the fluid and a change in the pressure within the chamber.

6. The fluid analysis assembly of claim 1, wherein the at least one sensor includes:

a pressure sensor for reading the pressure within the evaluation cavity of the chamber;

a temperature sensor for reading the temperature of the fluid within the evaluation cavity; and a bubble-point sensor for detecting the formation of bubbles within the fluid.

7. A down hole tool positionable in a well bore having a wall and penetrating a subterranean formation, the formation having a fluid therein, the down hole tool comprising:

a housing;

a fluid communication device extendable from the housing for sealing engagement with the wall of the well bore, the fluid communication device having at least one inlet for receiving the fluid from the formation;

a fluid analysis assembly positioned within the housing for analyzing the fluid, the fluid analysis assembly comprising:

a chamber defining an evaluation cavity for receiving the fluid from the fluid communication device;

a fluid movement device having a force medium applying force to the fluid to cause the fluid to move within the evaluation cavity;

a pressurization assembly changing the pressure of the fluid, wherein the assembly is able to change the pressure independently of the fluid movement device; and at least one sensor communicating with the fluid for sensing at least one parameter of the fluid.

8. The down hole tool of claim 7, wherein the pressurization assembly changes the pressure of the fluid in a continuous manner, and wherein the at least one sensor senses at least one parameter of the fluid while the pressure of the fluid is changing in the continuous manner.

9. The down hole tool of claim 7, wherein the chamber is characterized as a flow line.

10. The down hole tool of claim 9, wherein the evaluation cavity of the flow line is configured as a recirculating loop.

11. The down hole tool of claim 7, wherein the chamber comprises:

a flow line;

a first bypass loop communicating with the flow line and defining the evaluation cavity; and at least one valve positioned between the flow line and the evaluation cavity of the first bypass loop for selectively diverting fluid into the evaluation cavity of the bypass loop from the flow line.

12. The down hole tool of claim 11, wherein the chamber further comprises a second bypass loop communicating with the flow line and forming a separate evaluation cavity.

13. The down hole tool of claim 11, further comprising means for mixing fluid from the evaluation cavities defined by the first and second bypass loops.

14. The down hole tool of claim 7, wherein the fluid movement device includes a pump.

15. The down hole tool of claim 7, wherein the fluid movement device includes a mixing element positioned within the evaluation cavity and forming a vortex within the fluid, and wherein the sensor is positioned within the vortex.

16. The down hole tool of claim 7, wherein the fluid movement device and the pressurization assembly are integrally formed and collectively comprise:

a first housing defining a first cavity communicating with the evaluation cavity of the chamber;

a second housing defining a second cavity communicating with the evaluation cavity of the chamber, the first cavity having a cross-sectional area larger than a cross-sectional area of the second cavity;

a first piston positioned within the first cavity and movable within the first cavity; and a second piston positioned with the second cavity and movable within the second cavity, wherein the movement of the first and second pistons are synchronized to simultaneously cause movement of the fluid and a change in the pressure within the chamber.

17. The down hole tool of claim 7, wherein the at least one sensor includes:

a pressure sensor for reading the pressure within the evaluation cavity of the chamber;

a temperature sensor for reading the temperature of the fluid within the evaluation cavity; and a bubble-point sensor for detecting the formation of bubbles within the fluid.

18. The down hole tool of claim 7, wherein the fluid communication device includes at least two inlets with one of the inlets receiving virgin fluid from the formation, and wherein the down hole tool further comprises a flow line receiving the virgin fluid from one of the inlets of the fluid communication device and conveying the virgin fluid into the evaluation cavity.

19. A method for measuring a parameter of an unknown fluid within a well bore penetrating a formation having the fluid therein, comprising the steps of:

positioning a fluid communication device of the down hole tool in sealing engagement with a wall of the well bore;

drawing fluid out of the formation and into an evaluation cavity within the down hole tool;

moving the fluid within the evaluation cavity wit a fluid movement device;

changing a pressure of the fluid with a pressurization assembly without changing parameters of the fluid movement device; and sampling data of the fluid wit a sensor while the fluid is being moved within the evaluation cavity.

20. The method of claim 19, further comprising the step of continuously changing the pressure within the evaluation cavity while the data is being sampled.

21. The method of claim 20, further comprising the step of determining a bubble point of the fluid based on the sampled data.

22. The method of claim 19, wherein the evaluation cavity is defined further as a bypass loop from a main flow line, and wherein the method further comprises the step of:

diverting fluid from the main flow line into a separate evaluation cavity;

re-circulating the diverted fluid within the separate evaluation cavity; and sampling data of the diverted fluid within the separate evaluation cavity while the diverted fluid is being re-circulated.

23. The method of claim 22 further comprising the steps of:

mixing the fluids within the evaluation cavity and the separate evaluation cavity;

re-circulating the mixed fluid; and sampling data of the mixed fluid while the mixed fluid is being re-circulated.

24. The method of claim 19, wherein the fluid communication device is a dual-packer, and wherein the unknown fluid is a virgin fluid.

25. A down hole tool positionable in a well bore having a wall and penetrating a subterranean formation, the formation having a fluid therein, the down hole tool comprising:

a housing;

a fluid communication device extendable from the housing for sealing engagement with the wall of the well bore, the fluid communication device having at least one inlet for receiving the fluid from the formation;

a fluid analysis assembly positioned within the housing for analyzing the fluid, the fluid analysis assembly comprising:

a chamber defining an evaluation cavity configured as a re-circulating loop for receiving the fluid from the fluid communication device;

a fluid movement device having a force medium applying force to the fluid to cause the fluid to re-circulate within the re-circulating loop;

a pressurization assembly changing the pressure of the fluid; and at least one sensor communicating with the fluid for sensing at least one parameter of the fluid.

* * * * *